United States Patent [19]

Duplat

[11] Patent Number: 4,940,036

[45] Date of Patent: Jul. 10, 1990

[54] FUEL INJECTION PUMP

[75] Inventor: Gérard Duplat, Vaugneray, France

[73] Assignee: Robert Bosch GmbH, Stuttgart, Fed. Rep. of Germany

[21] Appl. No.: 315,895

[22] PCT Filed: May 28, 1989

[86] PCT No.: PCT/DE88/00312

§ 371 Date: Feb. 13, 1989

§ 102(e) Date: Feb. 13, 1989

[87] PCT Pub. No.: WO88/09868

PCT Pub. Date: Dec. 15, 1988

[30] Foreign Application Priority Data

Jun. 13, 1987 [DE] Fed. Rep. of Germany ..... 3719832

[51] Int. Cl.[5] ..... F02M 39/00

[52] U.S. Cl. ..... 123/506; 123/450; 417/462

[58] Field of Search ..... 123/506, 450, 458; 417/462

[56] References Cited

U.S. PATENT DOCUMENTS

| | | | |
|---|---|---|---|
| 4,426,983 | 1/1984 | Seilly | 123/506 |
| 4,531,491 | 7/1985 | Iiyama | 123/450 |
| 4,552,117 | 11/1985 | Djordjeuic | 123/506 |
| 4,604,980 | 8/1986 | LeBlanc | 123/450 |
| 4,711,618 | 12/1987 | Abinett | 123/450 |
| 4,725,209 | 2/1988 | Shirata | 123/450 |
| 4,840,162 | 6/1989 | Bruner | 123/450 |

*Primary Examiner*—Carl Stuart Miller

*Attorney, Agent, or Firm*—Michael J. Striker

[57] ABSTRACT

A distribution fuel injection pump for delivering fuel to injection nozzles of an internal combustion engine, said distribution fuel injection pump comprising a pump working space communicating with the inlet connected with a fluid source and an outlet connected with the injection nozzles, at least one pump plunger defining at least partially said pump working space, a distributor piston having a distributor bore communicating the pump working space with the outlet and a relief bore communicating the a relief space, and a control valve for controlling fluid flow through the outlet, said control valve including a valve element for controlling fuel flow between distribution bore and the relief bore of the distributor piston.

9 Claims, 2 Drawing Sheets

FUEL INJECTION PUMP

BACKGROUND OF THE INVENTION

The invention relates to a distribution a fuel injection pump for supplying a plurality of injection nozzles of an internal combustion engine, particularly a diesel internal combustion engine.

In a known fuel injection pump of this type (DE-OS 34 12 834), the control valve is arranged in the fuel inlet, while the distribution bore communicates with a relief opening whose opening and closing during the pump plunger stroke is dependent on the position of an electromagnetically actuated annular slide. The control valve, which is designed as a complete electric valve, is inserted in the pump housing as a separate constructional unit and is connected via bores with a pump work space and with a fuel inlet opening in the pump housing. The control valve and annular slide control the apportioning of the fuel quantity to be injected, wherein the end of injection, as well as the entire fuel delivery range, can be displaced relative to the pump plunger stroke.

In a known fuel injection pump constructed as a pump nozzle for a diesel engine (DE-OS 35 23 536), the control valve is connected between the pump work space and a relief bore. The pump work space is closed and the commencement of delivery of fuel to the injection nozzle is determined by the closing of the control valve. The pressure in the pump work space is reduced in a sudden manner and the fuel delivery is terminated by the opening of the control valve. The control valve, which is also designed in this instance as a complete electric valve, is again inserted in the pump housing as a complete constructional unit and connected via bores with the pump work space, on one side, and with a housing opening for the connection of a fuel return line, on the other side.

SUMMARY OF THE INVENTION

The object of the invention is a fuel injection pump with an extremely reduced dead volume in the pump work space and a low space requirement. This object is achieved by providing a control valve with a valve element integrated in a distributor piston and a valve opening which connects the distribution bore with a relief bore in the distributor piston. Instead of the complete electric valve, there is only a simple electromagnet in the pump housing itself. Bores in the pump housing for the connection of the control valve are dispensed with.

The present invention as to its construction so to its mode of operation, together with additional objects and advantages thereof, will be best understood from the following description with reference to the appended drawings.

DESCRIPTION OF THE PREFERRED EMBODIMENTS

Figure 1:
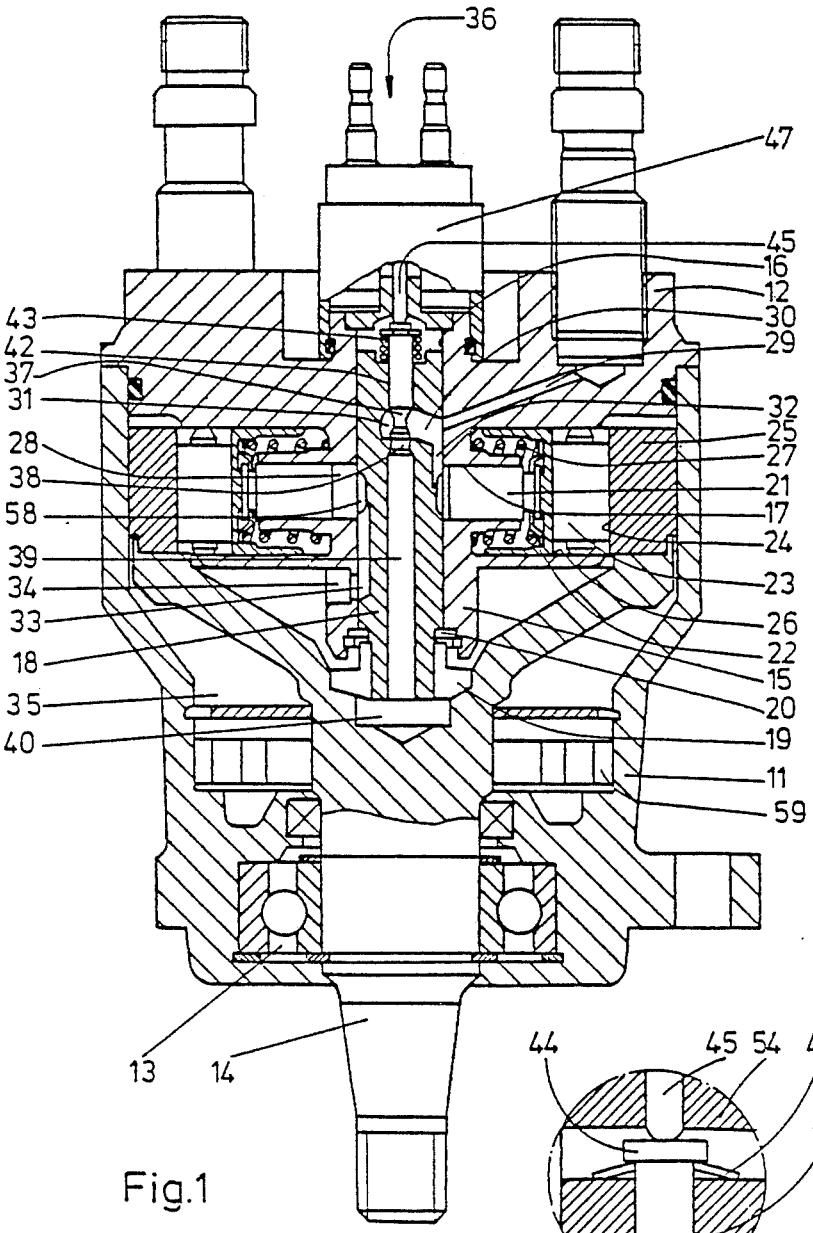
FIG. 1 shows a longitudinal sectional of a distribution fuel injection pump for a diesel internal combustion engine.

A distribution fuel injection pump shown in in FIG. 1 is a radial piston pump for supplying a total of four injection nozzles of a diesel engine with fuel in a preset proportion under an injection pressure. The fuel injection pump comprises a housing 11 which is closed by a housing cover 12 so as to be tight against liquid. A drive shaft 14 is rotatably supported in the housing 11 by a bearing 13. A cover part 15, which projects forward at the housing cover 12 in a hub-like manner, is provided with an axial cylinder bore 16 and a total of four radial bores 17 which are uniformly offset relative to one another in a cross-sectional plane, two of which radial bores 17 can be seen in FIG. 1. A distributor piston 18, which is coupled with the drive shaft 14 so that they are fixed for joint rotation, is supported in the cylinder bore 16. The coupling is effected via coupling elements 19 which engage in a positive-locking manner in grooves in the drive shaft 14, on one side, and in the distributor piston 18, on the other side. The distributor piston 18 is secured in its axial position by a retaining ring 20.

A pump plunger 21 is guided in the radial bore 17 in a tight manner and projects out of the radial bore hole 17 and is connected there with a tappet cup 22. The tappet cup 22 contacts the cam face 24 of a cam ring 25 via a cylinder or roller 23, the cam ring 25 being connected with the drive shaft 14 so that they are fixed for joint rotation with each other. Tappet cup 22 and roller 23 form a so-called roller tappet which is displaceable in a guide shaft 26 which is coaxial with the radial bore 17, so that the constructional unit comprising roller 23, tappet cup 22 and pump plunger 21 is able to follow the projections and recesses of the cam face 24 during the rotation of the cam ring 25. A helical pressure spring 27 supported at the base of the guide shaft 26 and in the interior of the tappet cup 22 provides for the force-locking contact of the tappet cup 22 at the roller 23 and of the roller 23 at the cam face 24.

Every pump plunger 21 defines a pump work space 28 on its inside, which pump work space 28 is open toward the distributor piston 18 and is defined there by an annular groove 58 on the distributor piston 18. In a cross-sectional plane of the housing cover 12 lying above the pump work space 28, four injection bore 29 which are uniformly distributed along the circumference, open into the cylinder bore 16, each injection bore 29 leading to one of a total of four injection nozzles. The distributor piston 18 contains a distributor bore 30 which opens into the interior of the distributor piston 18 in a valve space 31 and into a distributor groove 32 at the circumference of the distributor piston 18. The axial length of the distributor groove 32 is dimensioned in such a way that it extends from the annular groove 58 until the openings of the injection bores 29 and, in a suitable rotational position of the distributor piston 18, connects the pump work space 28 with an injection bore 29. In addition, the distributor piston 18 contains an axial inlet groove 33 which extends from four radial inlet bores 34 in the cover part 15, which are uniformly distributed along the circumference in a cross-sectional plane, until the annular groove 58, so that an inlet bore 34 is connected with the pump work space 28 in a suitable rotational position of the distributor piston 18. The inlet bores 34 open into the interior space 35 of the housing 11 which is filled with fuel by a delivery pump 59 which fits on the drive shaft 14, so that fuel can flow into the pump work space 28 via the inlet bore 34 during the suction stroke of the pump plunger 21.

The fuel quantity which is delivered to and injected at the assigned injection nozzle during every pump plunger stroke is apportioned by a control valve 36. The switching valve 36 comprises an electromagnetically actuated valve element 37 which controls a valve opening 38 which may seal the pump work space 28 for a pressure build-up or opened for the sudden decrease in pressure. The valve opening 38 and the valve element 37 are integrated in the distributor piston 18. For this purpose, the latter is provided with an axial relief bore 39 which opens out at the lower front side of the distributor piston 18 and communicates with the interior space 35 of the housing 11 via a recess 40 in the drive shaft 14. The relief bore 39 opens out into the valve space 31 via the valve opening 38. The clear width of the valve opening 38 is selected so as to be smaller than the bore diameter of the relief bore 39 (compare FIG. 2). The valve opening 38 is enclosed by a valve seat 41 on which the front end of the valve element 37 is pressed in the valve closing state, the valve element 37 being designed as a valve needle. The shaft 371 of the valve element 37 engages so as to be displaceable in a guide bore 42 aligned with the relief bore 39. This guide bore 42 passes through the distributor piston 18 from the valve space 31 to the upper front side. A valve spring 43, which is pretensioned in the valve opening direction, fits on the shaft portion of the valve element 37 projecting from the guide bore 42, the valve spring 43 being supported on the front side of the distributor piston 18 on one side and on a stop 44, e.g. a retaining ring, held at the valve element 37 on the other side. The front end of the valve element 37 remote of the valve opening 38 contacts the rounded end of a tappet 45 by the action of this valve spring 43, the tappet 45 being connected with the armature 46 of an electromagnet 47 for closing the switching valve 36.

The electromagnet 47 is constructed in a known manner and is described in detail, for example, in the DE-OS 35 23 536. Briefly expressed, the electromagnet comprises a coil 49 which is received on a core 48 and whose winding ends are connected with two connecting plugs 50. The plate-shaped armature 46 connected with the tappet 45 lies opposite the core 48, which is covered with a disk 53, accompanied by the formation of two air gaps 51, 52. The tappet 45 is guided so as to be axially displaceable in a centric housing portion 54 of the magnet housing 55, which housing portion 54 carries the core 48, wherein a return spring 56 is supported between the armature 46 and the housing portion 54. A lift stop 57 defines the lift movement of the armature 46 which contacts the lift stop 57 accompanied by the action of the return spring 56 when the coil 49 is without current.

The fuel injection pump described above operates as follows:

During the rotation of the drive shaft 14, the pump plungers 21—controlled by the cam face 24 of the cam ring 25—execute a reciprocating stroke movement. The distributor piston 18 connects the pump work space 28, which is defined by the pump plungers 21, with one of the inlet bores 34 and one of the injection bores 29 one after the other and in an alternating manner. The cam face 24 is constructed in such a way that the pump work space 28 is connected with an inlet bore 34 via the inlet groove 33 during a suction stroke of a pump plunger 21 and is connected with the injection bore 29 via the distributor groove 32 during a delivery stroke of the pump plunger 21. After filling the pump work space 28 with fuel, current is applied to the coil 49 of the electromagnet 47 at the start of the delivery stroke. The armature 46 is attracted against the restoring force of the return spring 56 and presses the valve element 37 on the valve seat 41 via the tappet 45. The valve opening 38 is accordingly closed and the relief bore 39 is separated from the pump work space 28. The fuel pressure now building up in the pump work space 28 continues until the injection nozzle and causes fuel to be injected into the combustion chamber of the diesel engine after overcoming the opening pressure of the injection nozzle.

In order to terminate the injection, the current feed to the electromagnet 47 is switched off. The armature 48 contacts the lift stop 57 accompanied by the action of the return spring 56. The valve element 37 rises from the valve seat 41 accompanied by the action of the valve spring 43 and releases the valve opening 38. Accordingly, the pump work space 28 is connected with the relief bore 39 via annular groove 58, valve groove 32, valve bore 30, valve space 31 and valve opening 38. The pressure in the pump work space 28 accordingly decreases suddenly and closes the injection nozzle, so that the injection is terminated. It is noted that the portion of the valve element 37 located in the valve space 31 is advantageously shaped in such a way that the pressure building up in the valve space 31 loads the valve element 37 in the opening direction. A sudden opening of the switching valve 36 is accordingly ensured when the electromagnet 47 is switched off.

Figure 3:
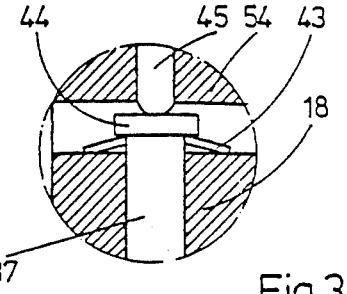
FIG. 3 shows a sectional view of a fuel injection pump according to another embodiment, which section is designated by III in FIG. 2.
Figure 2:
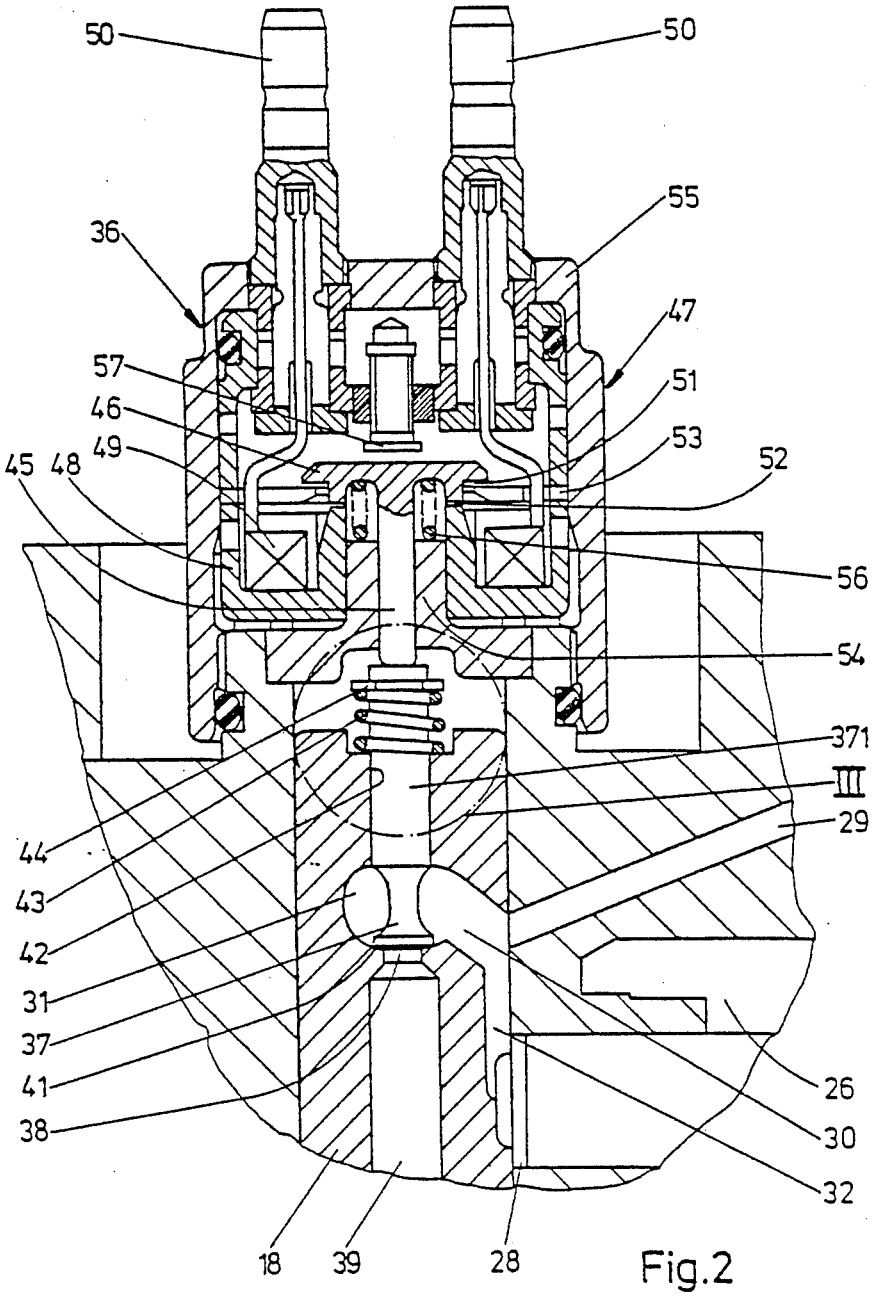
FIG. 2 shows an enlarged view of a control valve and the distributor piston of the fuel injection pump in FIG. 1.

In the variant of the fuel injection pump shown in section in FIG. 3, only the valve spring 43, which is constructed as a helical pressure spring in the embodiment in FIGS. 1 and 2, is replaced by a plate spring. This plate spring is preferably constructed as an elastic plastics material disk. Such a plate spring has a smaller overall height than a helical pressure spring, so that countersinking at the front sides of the distributor piston 18 and the housing portion 54 of the magnet housing 55, as provided in FIGS. 1 and 2 due to the reduction of the axial overall height, can be dispensed with.

What is claimed is:

1. A distribution fuel injection pump for delivering fuel to a plurality of injection nozzles of an internal combustion engine, said distribution fuel injection pump comprising an inlet communicating with a source of fuel; an outlet for delivering fuel to the injection nozzles; a pump working space communicating with said inlet and outlet; at least one pump plunger defining at least partially said pump working space; a rotatable distributor piston having a distributor bore communicating said pump working space with said outlet; and a control valve for controlling fluid flow through said outlet, said distributor piston comprising a relief bore communicating with a relief space, said control valve comprising a valve opening located in said distributor piston and connecting said distribution and relief bores, a valve member located in said distributor piston for controlling fluid flow through said valve opening to thereby control the fluid flow between said distribution bore and said relief bore, and an electromagnet for controlling movement of said valve member; said distributor piston comprising an axial guide bore, said valve member being formed as a valve needle having an end remote from said valve opening, said control valve further including a tappet actuated by said electromagnet and engaging said remote end, and a spring for biasing said valve needle to an open position thereof, said electromagnet having an armature, said tappet having a rounded front end engaging said remote end of said valve needle.

2. A distribution fuel injection pump for delivering fuel to a plurality of injection nozzles of an internal combustion engine, said distribution fuel injection pump comprising an inlet communicating with a source of fuel; an outlet for delivering fuel to the injection nozzles; a pump working space communicating with said inlet and outlet; at least one pump plunger defining at least partially said pump working space; a rotatable distributor piston having a distributor bore communicating said pump working space with said outlet; and a control valve for controlling fluid flow through said outlet, said distributor piston comprising a relief bore communicating with a relief space, said control valve comprising a valve opening located in said distributor piston and connecting said distribution and relief bores, a valve member located in said distributor piston for controlling fluid flow through said valve opening to thereby control the fluid flow between said distribution bore and said relief bore, and an electromagnet for controlling movement of said valve member; said distributor piston comprising an axial guide bore, said valve member being formed as a valve needle displaceable in said axial guide bore and having an end remote from said valve opening, said control valve further including a tappet actuated by said electromagnet and engaging said remote end, and a spring for biasing said valve needle to an open position thereof.

3. A distribution fuel injection pump according to claim 2, wherein said distributor piston has a front end, said valve member has a stop surface projecting radially therefrom, said spring being supported against said front end of said distributor piston and said stop surface.

4. A distribution fuel injection pump according to claim 3, wherein said spring is a helical pressure spring.

5. A distribution fuel injection pump according to claim 3, wherein said spring is a plate spring.

6. A distribution fuel injection pump according to claim 2, wherein said relief bore is coaxial with said axial guide bore and has a bore diameter, said valve opening having a diameter which is less than the diameter of said relief bore.

7. A distribution fuel injection pump according to claim 6, wherein said distributor piston has a valve space communicating with said distribution bore and having opposite sides, said relief bore and said axial guide bore being located on said opposite sides of said valve space.

8. A distribution fuel injection pump according to claim 7, wherein said valve member has a portion located in said valve space, said portion having a shape such that a pressure prevailing in said valve space produces a force component acting on said valve member in an opening direction.

9. A distribution fuel injection pump according to claim 2, wherein said distributor piston has an axis, said pump working space being arranged at a right angle to said axis, said at least one pump plunger being formed as a radial piston, said fuel injection pump further comprising means for driving said radial piston, said driving means including a cam ring and a roller tappet engaging said radial piston and rolling on said cam ring, said cam ring being jointly rotatable with said distributor piston.

* * * * *